United States Patent [19]

Petree et al.

[11] Patent Number: 4,649,684

[45] Date of Patent: Mar. 17, 1987

[54] PANEL SYSTEMS AND INSTALLATIONS

[75] Inventors: Larry M. Petree; Julian J. Attaway; Randolph W. Driggers, all of Tucker, Ga.

[73] Assignee: MM Systems Corporation, Tucker, Ga.

[21] Appl. No.: 784,462

[22] Filed: Oct. 4, 1985

[51] Int. Cl.[4] ..... E04B 1/62; E04D 1/34

[52] U.S. Cl. ..... 52/395; 52/466; 52/469; 52/478; 52/520

[58] Field of Search ..... 52/395, 466, 463, 469, 52/520, 478

[56] References Cited

U.S. PATENT DOCUMENTS

| | | | |
|---|---|---|---|
| 1,723,166 | 8/1929 | Hayman | 52/469 |
| 3,486,281 | 12/1969 | Gregoire | 52/463 X |
| 3,708,943 | 1/1973 | Thomas et al. | 52/478 X |
| 3,998,019 | 12/1976 | Reinwall, Jr. | 52/520 X |
| 4,361,998 | 12/1982 | Ellison et al. | 52/520 |
| 4,404,777 | 9/1983 | Lolley et al. | 52/94 X |
| 4,463,533 | 8/1984 | Mullet | 52/478 X |
| 4,476,658 | 10/1984 | Johnstone | 52/466 X |

FOREIGN PATENT DOCUMENTS

| | | | |
|---|---|---|---|
| 263657 | 11/1965 | Australia | 52/461 |
| 1204674 | 8/1959 | France | 52/465 |
| 1259585 | 3/1961 | France | 52/395 |
| 840133 | 7/1960 | United Kingdom | 52/520 |

*Primary Examiner*—Alfred C. Perham
*Attorney, Agent, or Firm*—John B. Armentrout

[57] ABSTRACT

Panel systems and installations thereof are provided wherein laterally opposite flanges of panel and flange means in the system form a gap with one another, and those flanges are adapted to be anchored to sub-structure, such as of a building, with the anchor means used for that purpose leading within the gap between the flanges and into grooves in the flanges which widen the gap locally between the flanges. Outer lateral ends of the anchored flanges are covered by cover means which engages engagable means of the panel and flange means.

26 Claims, 10 Drawing Figures

10
11a
11b
11c
12
13a
13c
14a
14b
15
16
16'
17
18
18'
19
20
20'
21
22
22'
23
24
25
26
30
31
32
32a
33
33a
34
35
36
37
38
39
40
41
50
50'
50a
50b
51
51a
52
52a
53

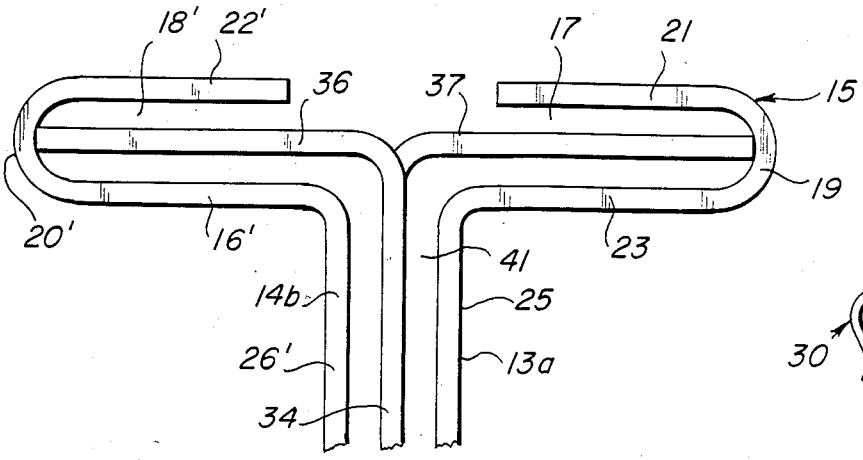
FIG. 4
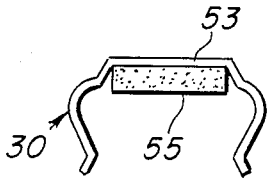
FIG. 5
FIG. 6
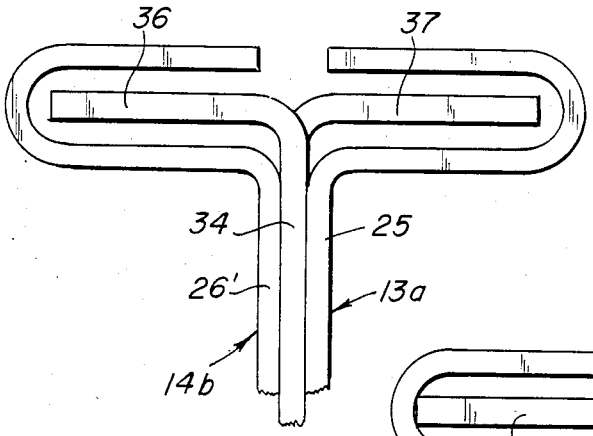
FIG. 7
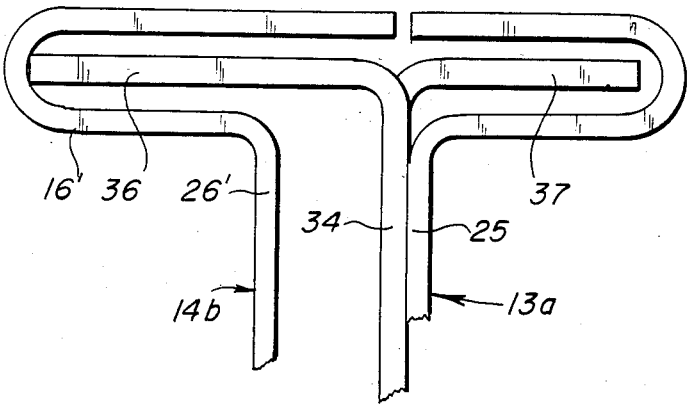

PANEL SYSTEMS AND INSTALLATIONS

The present invention relates to panel systems and installations thereof, and more particularly to systems which are characterized by having panels in the system with flanges on the panels for the flanges to be anchored to sub-structure.

An object of the present invention is to lend improvements in the field of anchoring flanges of panel members in a panel system to sub-structure and using cover means to cover the anchored joint.

Another object of this invention is to provide panel systems wherein panel and flange means in the system are interrelated in a practical manner with anchor means and with cover means in the system.

Other objects herein in part will be obvious and in part pointed out more fully hereinafter.

As conducive to a clearer understanding of certain aspects of this invention, panel systems fall into a highly competitive field and are in widespread demand for serving one or more of a variety of purposes, among which, and to exemplify those uses envisioned for the present invention, is to have the panel system installed, as produced so adapted, to cover sub-structure of a building, thereafter to be exposed outdoors as roofing or side wall structure, or in other instances to afford the facing of a side wall or ceiling of a building or vehicle, inside the building or vehicle. By way of exemplifying other uses, also among those further envisioned as outlets in accordance with the present invention, panel systems are needed as components of fences, or to provide flooring, such as where ribbed surfaces are to be introduced upwardly by the panel system serving as a loading platform, or as a floor of a truck or railway car, with the panel system bodily, as provided for the particular need, being strong enough commensurately to endure in use.

A further object herein, accordingly, is to achieve in panel systems an anchor joint and cover interrelation which quite satisfactorily allows the system to be produced to have bodily extent and strength for serving in actual practical use, as need may be, and to have the system be competitive on the market from the standpoint of cost and in view of the particular structural features offered in the system by the anchor joint and cover interrelation.

Referring now to panel systems constructed in accordance with the present invention, a covered joint, included usually in multiple in the system, entails having panel and flange means comprising first and second panels with flanges thereon longitudinally co-extending adjacent to one another in pair with the pair of panels in the joint, the panel and flange means moreover being provided with engagable means, and the flanges with laterally open longitudinal grooves. As disposed side by side in the pair, the flanges form a gap relatively to one another, having each groove where located widen the gap. Anchor means, also in the aforementioned joint, includes base means, laterally projecting means, and connecting means interconnecting the laterally projecting means with the base means, for the connecting means to lead within the gap between the pair of flanges and the laterally projecting means to extend from the gap into the grooves in the flanges while having the base means secured to sub-structure covered by the panels. Still further, cover means appurtenant to the aforementioned joint, is adapted to engage the engagable means of the panel and flange means while the cover means covers outer lateral ends of the flanges and the base means of the anchor means is secured to the sub-structure, having the connecting means of the anchor means lead in the gap between the pair of flanges and the projecting means of the anchor means extend into the grooves in the flanges. In embodiments which are preferred, the anchor means comprises a plurality of clips spaced apart from one another in a path longitudinally of the joint, having base means of the clips secured to the sub-structure, with connecting means of the clips to lead within the gap between the panel flanges, and projecting means of the clips to reach into the hereinbefore described longitudinally extending laterally open grooves in the panel flanges in the joint.

In the accompanying drawings representing certain embodiments of the present invention, including those which now are preferred:

FIG. 4 is an enlarged cross-sectional view of portions of the anchor means and panel flanges along a gap in the panel system of FIG. 1;

FIG. 5 is a transverse cross section of the cover member used in FIG. 1, but modified to include a seal;

FIGS. 6 and 7 are enlarged transverse cross-sectional detail views representing two different modifications, and comparable with FIG. 4 as to how panel flanges in a panel system are interrelated with the clips in a row to abut the clips;

Figure 9:
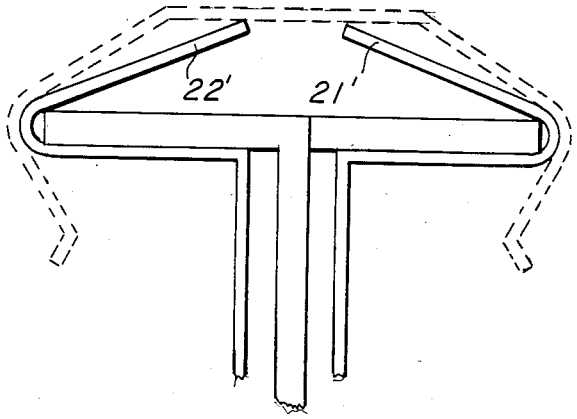
Figure 10:
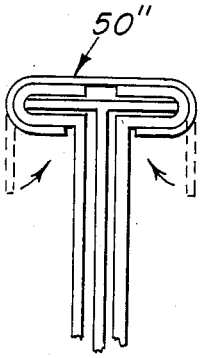

FIG. 9 provides a transverse cross-sectional view of a modified interrelation of the cover means with the members adjacent thereto in a panel system; and FIG. 10 is a transverse cross-sectional representation of another modified cover member as applied to a related one of the anchored joints in a panel system.

In an embodiment of the present invention provided in accordance with FIGS. 1 to 4, inclusive, in the accompanying drawings, a panel system designated in general by the reference numeral 10 includes a plurality of panels 11*a*, 11*b* and 11*c*. Panel 11*a* is the web of a channel 12 having laterally opposite parallel side flanges 13*a* and 14*a* longitudinally co-extending with panel 11*a* and thereby forming a trough with the panel. Panels 11*b* and 11*c* may be members of channels which are similar to the channel 12, and at least have flanges 14*b* and 13*c* which longitudinally co-extend with those panels as members thereof for the panels 11*b* and 11*c* to continue the panel system 10 laterally, such as to next flanges which may be present in the panel system.

Flanges 13*a* and 14*a* have about the same forward reach from the panel 11*a* in channel 12 and include protuberances in the form of recessed groove-forming components 15 and 16 at their outer lateral ends and the grooves 17 and 18, so formed, open laterally outwardly outside the channel 12 and preferably lie in a plane which is substantially parallel with panel 11*a*. The bight wall portions 19 and 20 of the groove-forming components 15 and 16 are wall bends outwardly rounded outside the grooves 17 and 18 and interconnect outer lateral legs 21 and 22 with legs 23 and 24 which are inner in the flanges 13*a* and 14*a* with reference to the outer legs 21 and 22 and are intermediate legs with reference to panel 11*a* and the outer legs 21 and 22. Between the panel 11*a* and the inner legs 23 and 24, there are laterally straight wall portions 25 and 26 of channel 12 which interconnect the inner legs 23 and 24 with the panel 11*a*, having the laterally straight wall portions 25 and 26 as innermost legs disposed at about right angles relatively to the inner legs 23 and 24 and to the panel 11*a*, and having the outer lateral legs 21 and 22 lead laterally about parallel to the inner legs 23 and 24 and panel 11*a*. As shown, the outer legs 21 and 22 and the inner legs 23 and 24 are approximately straight, laterally. Channel 12 is for example fabricated from galvanized sheet steel, from sheet aluminum-base alloy, or from synthetic resin sheeting, or the like, or for example may be an extrusion of any suitable material.

As pointed out hereinbefore, panels 11*b* and 11*c* may be members of channels which are similar to channel 12 or, if desired, either or both of the panels 11*b* and 11*c* on the other hand may be constructed and used for laterally terminating the panel system without having a flange at the lateral terminal end of the system. Let it be assumed, however, for purposes of facilitating further description herein, that panels 11*b* and 11*c* both are members of channels similar to channel 12 and that in fact any desired number of units similar to channel 12 may be used in the system laterally to prolong the system to any appropriate lateral and longitudinal terminal ends.

Since flange and anchor connections between the panels in system 10 may if desired be similar, attention now will be focused upon the connections which are made at flanges 13*a* and 14*b* in the system. Anchor means used includes a plurality of clips 30, each for example being similar to the others and being made from sheet steel or from any other suitable material. A base 31 of clips 30 (see FIG. 2) includes a pair of raised portions 32 formed such as by embossing. Portions 32 are spaced apart from one another with there being an aperture 39 through base 31 between the portions 32 to receive a suitable fastener. A struck-out tongue 33 from a connecting wall 34 in the clip 30 and forming a portion of the base 31 of the clip has an outer surface 33*a* which is about in the same plane with the outer surfaces 32*a* of the raised portions 32, thus having that plane be substantially parallel with the bottom of base 31. At outer end, the connecting wall 34 is integral with tabs or projections 35, 36 and 37 which lie in a plane substantially parallel with the bottom of base 31, having the projection 36 oppositely laterally directed relatively to the projections 35 and 37, thus producing a lateral free end of projection 36 on the opposite side of the connecting wall 34 from the lateral free ends of the projections 35 and 37.

Figures 1, 2, 3:
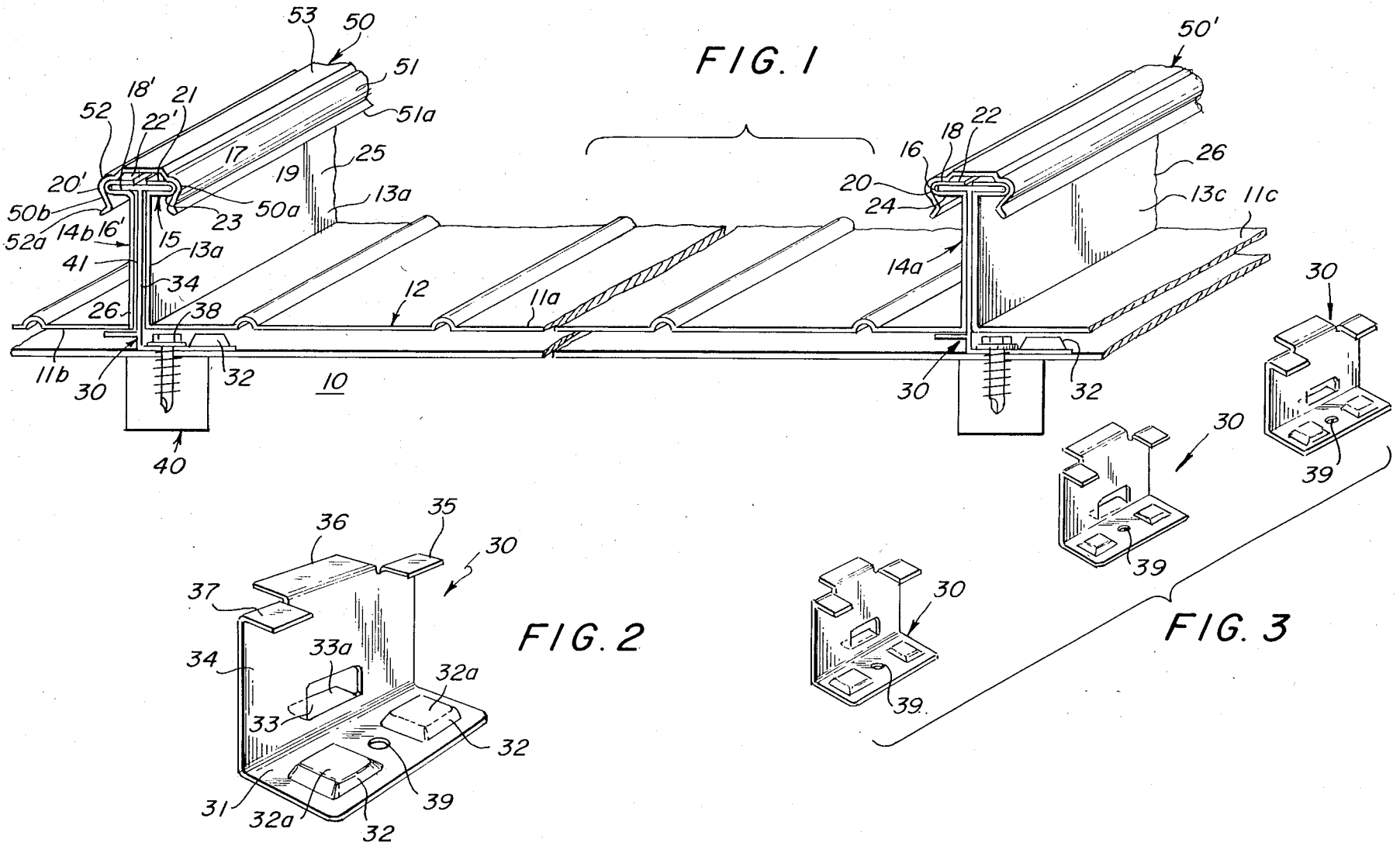
FIG. 1 is an isometric view of part of an installed panel system to bring forth features of the present invention, the view also introducing a transverse cross-sectional representation of further structural details.
FIG. 2 is an isometric view of one of the anchor clips used in the panel system of FIG. 1.
FIG. 3 represents a few of the clips of FIG. 2 as they occur along a row consistent with FIG. 1.

It will be understood from FIGS. 1, 3 and 4 that in producing a joint with flanges 13*a* and 13*b* on the adjacent panels 11*a* and 11*b*, a plurality of the clips 30 are introduced in a row in any suitable number spaced apart from one another in the row—note for example FIG. 3 representing a part of a row of such clips. The clips 30 in the row are connected by fasteners 38 through the apertures 39 in the bases 31 of the clips to a sub-structure 40 which is to carry the system 10 and be covered by that system. It will further be seen from FIGS. 1, 3 and 4 that under these conditions, the projections 36 of clips 30 in the row are received in groove 18' in the flange 14*b*, with the projections 35 and 37 of clips 30 in the row also being received in groove 17 in the flange 13*a*. As shown, and as preferred, grooves 17 and 18' as engaged with the clips 30 are substantially directly opposite from one another. Further, in the present embodiment, the groove-forming portions 15 and 16' of the flanges 13*a* and 14*b* are moved to bring the bight wall components 19 and 20' thereof against the outermost lateral ends of the projections 35, 36 and 37 of the clips inside the grooves 17 and 18', thus to have the projections 35, 36 and 37 laterally endwise serve as abutments for arresting further movement of the groove-forming portions 15 and 16' of the flanges 13*a* and 14*b* toward one another. A gap 41 accordingly is formed between the flanges 13*a* and 14*b* having the connecting walls 34 of the clips 30 in the row lead in the gap and having the projections 35, 36 and 37 of the clips 30 lead laterally from the gap into the grooves 17 and 18' which widen the gap in locations adjacent to opposite sides of the clips. Panel 11*a* meanwhile rests upon or is otherwise contiguous to the outer surfaces 32*a* of the raised portions 32 of the clips 30 in the row, and panel 11*b* rests upon or is otherwise contiguous to the outer surfaces 33*a* of the tongues 33 on the clips 30 in the row. In certain embodiments, still in accordance with the present invention, the raised portions 32 and the tongues 33 are omitted from the clips such as to have the panels along with their flanges suspended in the panel system from projections 35, 36 and 37.

Cover means for covering the joint and gap 41 in the panel system 10 includes a snap-on cover member 50 having a pair of side walls 51 and 52 interconnected by a web 53. The side walls 51 and 52 are curved outwardly outside the cover member 50 and inwardly inside the cover member so as to provide laterally entrant cavities 50*a* and 50*b* inside the cover member to receive in those cavities the rounded bight wall portions 19 and 20' provided by the groove-forming components 15 and 16' of the flanges 13*a* and 14*b*. Lateral end portions 51*a* and 52*a* of the cover member side walls 51 and 52 are slanted inwardly toward the interior of the cover member 50 adjacent to the cavities 50*a* and 50*b*, to facilitate moving the cover member in favor of attaining a snap action, following which the groove-forming portions 15 and 16' of the flanges 13*a* and 14*b* are both in the cavities 50*a* and 50*b*. In final position, the cover member 50, as will be seen in FIG. 1, serves to hold the bight wall components of the groove-forming portions 15 and 16' against the ends of projections 35, 36 and 37 inside the grooves 17 and 18'. Cover members similar to the cover member 50 may be added if need be to prolong the coverage of the joint longitudinally or to cover other joints in the system 10 such as the next similar joint with cover member 50' in FIG. 1.

It is sometimes beneficial in accordance with this invention to adapt the cover member to snap-engage the groove-forming portions of the flanges loosely and thereafter during installation adjust the cover member as by deforming the same for the cover member, in final position thus provided, to engage the groove-forming portions tightly. In other instances, also in accordance with this invention, the cover member is adapted to engage the groove-forming portions tightly without any need for adjustment after being snapped into place.

The cover member 50, represented in FIG. 1, further is provided having the web 53 thereof recessed, which well adapts the cover member 50 to carry a sealant 55, as will be seen in FIG. 5. Sealant 55 may for example be a resilient elastomeric strip cemented to the web 53 to co-extend with the cover member 50 throughout the length of that member, or for example be a mastic substance of similar longitudinal extent applied inside the cover member 50 to the face of web 53. The sealant 55 is adapted to contact and seal against the outer faces of the outer lateral legs 21 and 22' of the groove-forming portions 15 and 16' described hereinbefore with reference to FIG. 1, when the cover member 50 is in final position as installed. Where the sealant 55 is a resilient elastomeric material, the sealant, besides sealing the compound joint, serves to bias the cover member 50 in an outward direction, thereby promoting mechanical and fluid tightness.

In a modified embodiment of this invention, represented in FIG. 6, and differing in how the panel flanges 13*a* and 14*b* are abutted against the clips 30 in the row, the lateral reach of the clip projections 35, 36 and 37 has been reduced, thereby allowing the laterally straight wall portions 25 and 26' of the flanges 13*a* and 14*b*, as installed, to abut against the connecting walls 34 of the clips 30 in the row instead of against the ends of the clip projections 35, 36 and 37. In this same general respect, in another modified embodiment of this invention represented in FIG. 7, the lateral reach of projections 35 and 37 of the clips 30 in the row has been reduced, thereby allowing the laterally straight wall portion of the flange 13*a*, as installed, to abut against the connecting walls 34 of the clips 30 in the row while the groove-forming portion 16' of flange 14*b*, as installed, is abutted against the ends of projections 36 of the clips 30 in the row.

Figure 8:
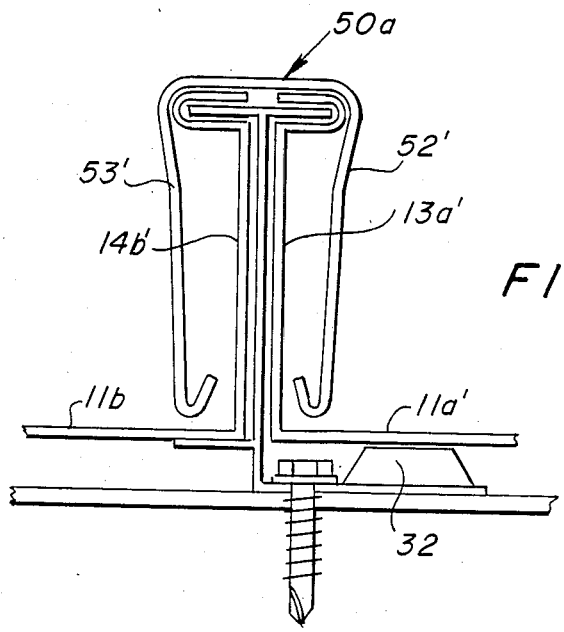
FIG. 8 is a transverse cross-sectional representation of a modified type of cover member which may be used in the panel system.

In FIG. 8, a modification in accordance with the present invention provides legs 52' and 53', of a snap-on cover member 50*a*, which are laterally prolonged to reach to be contiguous to the related panel members 11*a'* and 11*b'* in the regions of the junctures of the flanges 13*a'* and 14*b'* of those panel members in the anchored joint, having the cover member 50' applied. The cover member 50*a* as associated with the panels accordingly substantially fully encloses the flanges 13*a'* and 14*b'* in the anchored joint.

In the FIG. 9 embodiment, covered joints similar to those disclosed with reference to FIGS. 1 and 4 are provided in the panel system, except that the outer lateral legs 21' and 22'' of the panel flanges in the joint are at least initially outwardly inclined toward one another so as resiliently to press outwardly against the cover member, seen in dotted lines in FIG. 4, after the cover member has been applied.

While a snap-on cover feature as described hereinbefore is preferred in panel systems in accordance with the present invention, it will be understood that certain advantages, still in accordance with this invention, are had where instead a non-snap-on type cover member 50'', such as initially in the form of an inverted generally right angular channel, having straight legs as shown in dotted lines in FIG. 10, is seated upon the anchored panel flanges provided as hereinbefore described in the joint, and thereafter is deformed to clench the cover member tightly in place such as by use of machine or manually applied clinching forces.

The present invention is, of course, in no way restricted to the specific disclosure of the specification and drawings herein, but also encompasses any modifications within the scope of the appended claims.

We claim:

1. In a panel system for being associated with sub-structure, the combination which includes; panel and flange means comprising, first and second panels, a first flange on said first panel, a second flange on said second panel, and said flanges each including, an outer wall member provided with a lateral end of said flange, an intermediate wall member, and a wall bend interconnecting said outer and intermediate wall members and defining a lateral protuberance therewith having said wall bend for an outermost end, with a longitudinal groove being inside said protuberance and laterally entrant directly toward said outermost end of said protuberance, and said flanges further including inner wall members interconnecting said intermediate wall members with said panels and thus disposing said intermediate wall members and said outermost ends of said protuberances outside said panels and disposing said grooves to be open between said outer and intermediate wall members of the related one of said flanges toward the other of said flanges when said flanges are side by side having said grooves laterally entrant directly toward said outermost ends of said protuberances, and to have said outer wall members from said outermost ends of said protuberances be disposed forwardly sidewise of said intermediate wall members and laterally co-extending therewith to reach said lateral ends of said flanges; anchor means to be secured to said sub-structure and comprising projecting means laterally from opposite sides of said anchor means to reach inside said grooves in said protuberances and present ends of said projecting means toward said outermost ends of said protuberances inside said grooves, when having said anchor means secured to said sub-structure with said opposite sides of said anchor means being between said flanges outside said grooves and with said flanges being against said anchor means; and cover means for being securely engaged with said outermost ends of said protuberances inside recesses in said cover means, while said flanges are against said anchor means and said cover means is covering said outer wall members and said lateral ends of said flanges, under conditions of said anchor means being secured to said sub-structure with said opposite sides of said anchor means being disposed between said flanges outside said grooves in said protuberances and said projecting means being inside said grooves and endwise directed toward said outermost ends of said protuberances and said recesses in said cover means.

2. A panel system as set forth in claim 1, wherein said cover means substantially conforms in said recesses therein in curvature to said wall bends of said flanges when said cover means is in place.

3. A panel system as set forth in claim 1, wherein said intermediate wall members of said flanges laterally lead generally parallel with said panels.

4. A panel system as set forth in claim 1, wherein said outer wall members of said flanges laterally lead generally parallel with said intermediate wall members of said flanges and said panels.

5. A panel system as set forth in claim 1, wherein said intermediate wall members of said flanges laterally lead generally parallel with said panels, and said outer wall members of said flanges laterally leading from said outermost ends of said protuberances diverge from said intermediate wall members of said flanges.

6. A panel system as set forth in claim 1, wherein said intermediate wall members of said flanges laterally are approximately straight wall members.

7. A panel system as set forth in claim 1, wherein said intermediate and inner wall members of said flanges laterally are approximately straight wall members and said inner wall members are disposed at about right angles with reference to both said intermediate wall members and said panels.

8. A panel system as set forth in claim 1, wherein said system includes resilient sealing means for said resilient sealing means to be sealingly against said cover means and said outer wall members of said flanges, and bias said cover means outwardly, while said cover means is engaged with said outermost ends of said protuberances.

9. A panel system as set forth in claim 1, wherein said cover means, in engaging said outermost ends of said protuberances and thereafter covering said outer wall members and said lateral ends of said flanges and holding said flanges against said anchor means, presses inwardly against said outer wall members of said flanges and is resiliently biased outwardly by said outer wall members of said flanges.

10. A panel system as set forth in claim 9, wherein said outer wall members of said flanges leading laterally from said outermost ends of said protuberances toward said lateral ends of said flanges diverge from said intermediate wall members of said flanges for being deflected inwardly and thereafter resiliently biasing said cover means forwardly.

11. A panel system as set forth in claim 1, wherein said cover means is snap-enagagable with said outermost ends of said protuberances and serves, either immediately and upon being adjusted, to hold said flanges against said anchor means, while covering said outer wall members and said lateral ends of said flanges and having said projecting means endwise directed in said grooves toward said outermost ends of said protuberances and toward said recesses in said cover means, with said anchor means being secured to said sub-structure.

12. A panel system as set forth in claim 11, wherein said cover means, in engaging said laterally outermost ends of said protuberances and thereafter covering and holding said flanges against said anchor means, presses resilient sealing means between said cover means and said flanges sealingly against said outer wall members of said flanges, and is resiliently biased outwardly by said resilient sealing means.

13. A panel system as set forth in claim 11, wherein said cover means, in engaging said outermost ends of said protuberances, and thereafter covering said outer wall members and said lateral ends of said flanges and holding said flanges against said anchor means, presses against said outer wall members of said flanges and is resiliently biased outwardly by said outer wall members of said flanges.

14. A panel system as set forth in claim 1, wherein said outermost end of each of said protuberances is convexly curved outside said protuberance, and said cover means before being snapped into place has said recesses therein at least preliminarily defined sufficiently for said cover means to be snap-engaged with said outermost ends of said protuberances, having said projecting means directed in said grooves inside said protuberance toward said outermost ends of said protuberances, with said anchor means being secured to said sub-structure, for said cover means thereafter, either immediately and upon being adjusted, to hold said flanges against said anchor means.

15. A panel system as set forth in claim 14, wherein side walls of said cover means flare outwardly from one another outside said recesses in said cover means, for guiding said cover means on said convexly curved outermost ends of said protuberances to receive said outermost ends of said protuberances in said recesses through snap-engagement of said cover means.

16. A panel system as set forth in claim 1, wherein said anchor means and said flanges are adapted for said opposite sides of said anchor means to abut said inner wall members of said flanges, while having said anchor means secured to said sub-structure and having said projecting means of said anchor means inside said grooves and toward said outermost ends of said protuberances, with said cover means meanwhile being engaged in said recesses therein with said outermost ends of said protuberances.

17. A panel system as set forth in claim 1, wherein said anchor means includes, a plurality of clips comprising, said projecting means, connecting means affording said opposite sides of said anchor means, and base means interconnected with said projecting means by said connecting means, for said base means to be secured to said sub-structure having said clips spaced apart from one another along a path.

18. A panel system as set forth in claim 17, wherein said base means of said clips includes rest means upon which said panels may rest, having said projecting means inside said grooves in said protuberances and said connecting means between said flanges outside said grooves, when said base means is secured to said sub-structure.

19. A panel system as set forth in claim 1, wherein upon having said anchor means secured to said sub-structure and abutted by said flanges, with said projecting means being inside said grooves in said protuberances and with opposite sides of said anchor means being between said flanges outside said grooves, said grooves open toward one another when said cover means is in place.

20. In a panel system as set forth in claim 1, wherein said cover means includes side wall extensions, for said side wall extensions to co-extend with said inner wall members of said flanges spaced apart throughout from said inner wall members, and reach contiguous to said panels in the immediate regions of junctions of said panels with said inner wall members of said flanges when said cover means is in place, to have said cover means thus substantially fully enclose said inner wall members of said flanges.

21. In a panel system for being associated with sub-structure, the combination which includes; panel and flange means comprising, first and second panels, a first flange on said first panel, a second flange on said second panel, and said flanges each including, an outer wall member provided with a lateral end of said flange, an intermediate wall member, and a wall bend interconnecting said outer and intermediate wall members and defining a lateral protuberance therewith having side wall bend for an outermost end, with a longitudinal groove being inside said protuberance and laterally entrant directly toward said outermost end of said protuberance, and said flanges further including inner wall members interconnecting said intermediate wall members with said panels and thus disposing said intermediate wall members and said outermost ends of said protuberances outside said panels and disposing said grooves to be open between said outer and intermediate wall members of the related one of said flanges toward the other of said flanges when said flanges are side by side having said grooves laterally entrant toward said outermost ends of said protuberances, and to have said outer wall members from said outermost ends of said protuberances be disposed forwardly sidewise of said intermediate wall members and laterally co-extending therewith to reach said lateral ends of said flanges; anchor means to be secured to said sub-structure and including projecting means laterally from opposite sides of said anchor means to reach inside said grooves in said protuberances and present ends of said projecting means directly toward said outermost ends of said protuberances inside said grooves, for said projecting means endwise to abut said outermost end of at least one of said protuberances, upon having said anchor means secured to said sub-structure and said opposite sides of said anchor means be between said flanges with said flanges against said anchor means; and cover means for being securely engaged with said outermost ends of said protuberances inside recesses in said cover means, while said flanges are against said anchor means and said cover means is covering said outer wall members and said lateral ends of said flanges, under conditions of said anchor means being secured to said sub-structure with said opposite sides of said anchor means being disposed between said flanges outside said grooves in said protuberances, and said projecting means being inside said grooves and endwise directed toward said outermost ends of said protuberances and endwise abutting said outermost end of at least one of said protuberances.

22. A panel system as set forth in claim 21, with said projecting means being adapted for said ends thereof to abut said outermost ends of both of said protuberances inside said grooves, thus having said flanges against said anchor means, when said cover means is in place with said anchor means being secured to said sub-structure and said opposite sides of said anchor means being between said flanges.

23. In a panel system to be associated with sub-structure, the combination which includes; a pair of panel system flanges to be laterally opposite one another and having outer lateral ends and a pair of longitudinal grooves for each of said grooves to be open from the related one of said flanges laterally toward said groove in the other of said flanges, each of said grooves being defined by a wall bend laterally outermost of said groove and by a pair of wall members directly from said wall bend with one of said wall members in said pair leading to said outer end of said flange; anchor means including a plurality of clips to be secured to said sub-structure and be abutted by said flanges between said flanges, and said clips having projecting means with ends to be inside said grooves and directed toward said wall bends with said grooves opening laterally toward one another; and cover means to be engaged with side wall bends within recesses inside said cover means, for covering adjacent said ones of said wall members in said pairs of wall members and said outer lateral ends of said flanges while said flanges abut said clips, having said clips secured to said sub-structure and said ends of said projecting means directed toward said wall bends inside said grooves and toward said recesses inside said cover means with said grooves opening laterally toward one another.

24. In a panel system as set forth in claim 23, wherein at least one of said flanges has said wall bend thereof abut some of said ends of said projecting means, upon said projecting means being endwise inside said grooves with said flanges against said clips and said clips being secured to said sub-structure.

25. In a panel system as set forth in claim 23, wherein at least one of said clips is abutted by at least one of said flanges outside said groove in said flange, upon said projecting means being endwise inside said grooves with said flanges against said clips and said clips being secured to said sub-structure.

26. In a panel system installation, the combination which includes; a pair of laterally opposite panel system flanges having outer lateral ends and a pair of longitudinal grooves laterally open one in each of said flanges toward the other in said pair of grooves, each of said grooves being defined by a wall bend laterally outermost of said groove and a pair of wall members directly from said wall bend, with one of said wall members in said pair of wall members leading to said outer lateral end of said flange; anchor means including a plurality of clips secured to sub-structure and being abutted by said flanges with said clips leading between said flanges and having projecting means inside said grooves and endwise directed toward said wall bends; and cover means engaged with said wall bends within recesses inside said cover means, having said recesses aligned with said projecting means inside said grooves and said cover means covering adjacent said ones of said wall members in said pairs of wall members and said outer lateral ends of said flanges.

* * * * *